United States Patent [19]

Kratchmer

[11] 4,321,779

[45] Mar. 30, 1982

[54] WALL SYSTEM UTILIZING INTERLOCKING BLOCK AND TIES

[75] Inventor: James Kratchmer, Blackie, Canada

[73] Assignee: Speed-Form Manufacturing Ltd., Canada

[21] Appl. No.: 67,906

[22] Filed: Aug. 20, 1979

[51] Int. Cl.[3] ..... E04B 2/00

[52] U.S. Cl. ..... 52/425; 52/426; 52/564

[58] Field of Search ..... 52/426, 429, 425, 562, 52/568, 564, 565, 561, 430

[56] References Cited

U.S. PATENT DOCUMENTS

| | | | |
|---|---|---|---|
| 1,127,058 | 2/1915 | Marshall | 52/564 |
| 1,620,834 | 3/1927 | Rhodes | 52/426 X |
| 1,699,554 | 1/1929 | Wigglesworth | 52/564 X |
| 2,029,082 | 1/1936 | Odam | 72/30 |
| 2,181,698 | 11/1939 | Langenberg | 52/564 X |
| 2,372,038 | 3/1945 | Westveer | 72/16 |
| 2,676,482 | 4/1954 | Wilson | 52/564 |
| 3,238,689 | 3/1966 | Cook, Jr. | 52/717 |
| 3,562,991 | 2/1971 | Kustusch | 52/564 |

FOREIGN PATENT DOCUMENTS

| | | | |
|---|---|---|---|
| 922495 | 3/1973 | Canada | 25/79 |
| 941588 | 2/1974 | Canada | 25/79 |
| 266956 | 3/1927 | United Kingdom . | |

*Primary Examiner*—Price C. Faw, Jr.
*Assistant Examiner*—Carl D. Friedman
*Attorney, Agent, or Firm*—Leydig, Voit, Osann, Mayer and Holt

[57] ABSTRACT

This invention relates to a wall element for use in constructing walls, and a wall system constructed of two parallel rows of a plurality of the wall elements laid in courses in interconnecting relationship, the wall system being used as construction forms for retaining fluid concrete poured into the space therebetween, whereby the two walls remain as a permanent part of the completed wall system, and a method of constructing the described wall system from the wall elements and accessory parts. The invention includes a wall element for use in association with other similar wall elements in the construction of a wall. The wall element has a top, a bottom, two side and two end surfaces, and at least one longitudinal groove in the top or bottom surface thereof, and a matching longitudinal ridge in the opposite top or bottom surface thereof, and second and third horizontal longitudinally extending grooves on at least the top surface of the wall element, both being parallel to the first longitudinal groove. The second and third grooves are located in the region of the respective ends of the top surface of the wall element.

9 Claims, 14 Drawing Figures

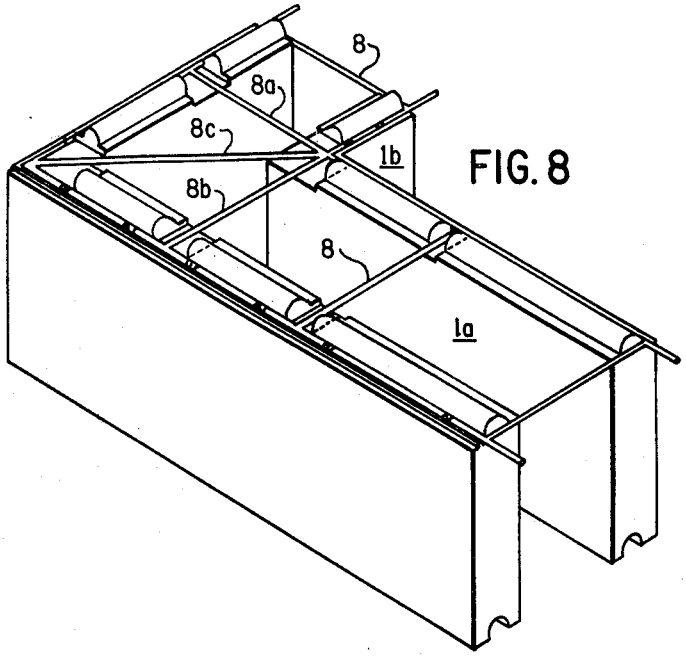
FIG. 8
FIG. 9
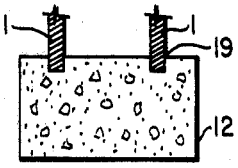
FIG. 10
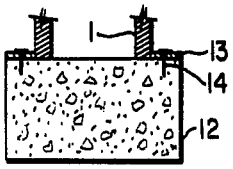
FIG. 11
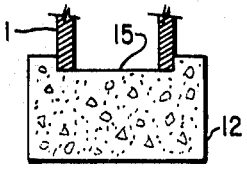
FIG. 12
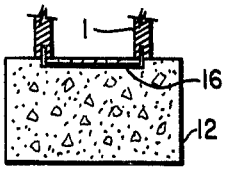
FIG. 13
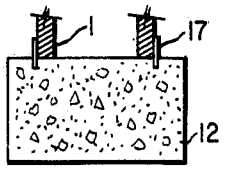
FIG. 14
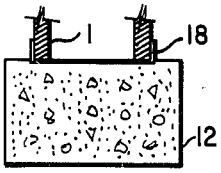

WALL SYSTEM UTILIZING INTERLOCKING BLOCK AND TIES

This invention relates to a wall element for use in constructing walls, and a wall system constructed of two parallel rows of a plurality of the wall elements laid in courses in interconnecting relationship, the wall system being used as construction forms for retaining fluid concrete, or other materials such as sand, paper, insulation, or other filler materials, poured into the space therebetween, whereby the two walls remain as a permanent part of the completed wall system, and a method of constructing the described wall system from the wall elements and accessory parts.

BACKGROUND OF THE INVENTION

In concrete forming, to construct walls and the like, it is common practice, to construct a temporary form from lumber, or other materials, to provide a retaining space into which concrete alone, or in combination with other materials, is poured in its fluid condition, after which the concrete is allowed to set. After the concrete has set to a predetermined solid form capable of supporting itself, the form is stripped away. Sometimes, the surfaces of the concrete are cleaned and patched to give a smooth surface if that is required by the job specifications. The forming material is hauled away, perhaps to be discarded, or to be used on another job site, if the forming material can be so adapted.

Because of the considerable hydrostatic pressure that is created by the concrete when it is poured to any reasonable depth, considerable lumber, or other materials, and sturdy construction of the forms are required to provide the necessary strength to retain the heavy concrete. Considerable time and hence expense is required by carpenters or other assembly men to construct the forms which in the end serve only a temporary purpose, namely, retention of the poured-in-place concrete until it has set to a strength strong enough to support itself.

The result of this conventional method of forming concrete walls and the like usually gives an uneven surface showing the imprint of the form itself. Further, the concrete often is not tamped into all areas of the form sufficiently, thereby causing depressions, gaps or other imperfections in the poured-in-place concrete. These imperfections must subsequently be repaired by a cement patching technique which involves extra time and expense. Further, when the concrete forming technique described is used, decorative finishes to the concrete surface cannot be provided without further work and procedure.

The applicant is the owner of two Canadian patents, Canadian Pat. Nos. 922,495, granted Mar. 13, 1973, and Canadian Pat. No. 941,588, granted Feb. 12, 1974, both naming John Rudichuk as inventor. These two patents disclose and claim a wall forming system that comprises a series of wall elements that are laid in superimposed courses in two parallel rows, to provide a pour space therebetween. The two parallel rows of elements are held in place by a system of H-hooks. When the parallel walls have been erected with the H-hooks in place, the fluid concrete is poured in the pour space between the parallel walls and is permitted to set. The concrete sets with the wall elements and H-hooks in place to provide a unitary wall system.

In the Rudichuk wall system, the wall elements must be constructed to close tolerances with holes therein for receiving the legs of the H-hooks. The H-hooks must also be constructed to close tolerances so that they will fit in the holes in the wall elements. The holes in the wall elements and the close tolerances required increase the basic production cost of the wall elements and the H-hooks. The protruding legs of the H-hooks also slow erection time because the holes in the wall elements must be carefully fitted over the legs, a time consuming procedure. Furthermore, the wall elements are flat on the top, bottom and end surfaces and hence when they are placed in abutting relationship with each other, there is no barrier to the passing of moisture between the respective wall elements.

To provide further background for the invention, the following is a list of United States and British patents that disclose and claim various systems for forming walls using wall elements and various tying systems:

| U.S. Pat. No. | Inventor |
|---|---|
| 2,029,082 | Odam |
| 2,181,698 | Langenberg et al. |
| 2,372,038 | Westveer |
| 3,238,684 | Wood |
| 3,562,991 | Kustusch |
| **British Patent No.** | **Inventor** |
| 266,956 | Bemis |

SUMMARY OF THE INVENTION

The present invention overcomes many of the disadvantages of the prior systems in the art by utilizing an outer form made up of two parallel rows of a plurality of wall elements held in fixed relation by horizontally disposed H-hooks, between which fluid concrete or other filling material such as sand, paper, insulation, or the like, is poured. The finished wall is comprised of the poured-in-place concrete, or other filling material, the H-hooks and the plurality of wall elements, the latter of which remain as part of the overall wall structure and make up the outwardly visible surface of the structure. The poured concrete or other filling material is concealed. The wall elements and the concrete or filling material poured therebetween, by being secured together by the system of H-shaped cross ties provides a wall structure that is held in place in somewhat the same manner as are concrete walls held together by steel reinforcing rods.

To add strength to the overall wall, a suitable adhesive material may be applied between the wall elements to cement them together. The adhesive material can also serve as a vapour barrier to prevent or inhibit the passage of water vapour between the wall elements.

The danger well known in the concrete construction art of having the wall collapse by the removal of forms before the concrete reaches its self-supporting strength is eliminated since the combination of wall elements and H-cross ties form part of the wall structure and thereby provide a basically self-supporting wall. A saving in time, labour and material costs may be realized over conventional concrete construction techniques because construction and subsequent removal and disposal of conventional forms is not required. The wall is complete once the concrete or other filling material has been poured into the cavity between the parallel rows of wall elements and adhesive material applied in the joints, if adhesive is being used.

With the precast members, subflooring construction can commence immediately after pouring, thus saving time. With the present invention, much of the conventional bracing and supports is not required, and also conventional excavation required to accommodate such supports is not required because the form is essentially self-supporting. In addition, because exterior supporting form work is not usually required, it is possible to erect a wall according to the subject invention very close to adjoining structures, or objects. Erection of the subject invention can also take place relatively quietly, and this is an advantage in areas where the usual construction noise cannot be tolerated or is prohibited.

The width of the concrete pour space between the form walls can be varied by using H-cross ties of varying cross bar size to suit the nature of the wall construction required. The size and configuration of the retaining wall elements themselves can be varied by selecting appropriate types and quantities of wall elements. The individual wall elements may be cast with assorted surfaces such that the completed wall provides a decorative block appearance, or a flat, uniform surface.

There are several main advantages of the subject invention over prior wall constructions known to the applicant. These advantages are discussed as follows:

(1) The basic wall elements, unlike most other wall building blocks taught in the art, have no holes, openings, or wells therein. The basic wall elements are of relatively simple construction, and this uncomplicated design lends itself to low cost and easy, reliable production of the basic wall elements. A static mold can be used to form the wall elements, and no moving parts are required in order to form holes, or other openings, in the wall element.

(2) The tongue and groove design of the basic wall element, particularly when the tongue and grooves extend on all four end surfaces of the wall element, provide upon interlocking with one another a natural moisture transmission barrier, a feature which is not present when the ends of the building blocks are formed with flat abutting edges. Moisture penetration into walls of buildings, and the like, can frequently be a troublesome problem, because moisture tends to promote deterioration and degradation of the wall system. To improve the water barrier properties or strength of the wall, adhesive can optionally be used in the tongue and groove joints.

(3) In the wall systems disclosed in Canadian Pat. Nos. 922,495, and 941,588, both naming John Rudichuk as inventor, an average of four H-ties per building block are required. In the present invention, only an average of two H-shaped cross-ties are required per wall element. A basic H-shaped cross-tie is a relatively expensive item and cutting in half the substantial number of H-shaped cross-ties that must be used in erecting the wall, can result in a considerable construction cost saving.

(4) The subject invention enables a wall to be erected in a very simple manner. The horizontally disposed H-cross tie design lends itself to simplicity in erecting the wall because there are no holes, openings or wells in which ties must be fitted, and no vertically extending legs of vertically disposed H-shaped cross-ties, over which holes or openings in the wall element in the next course of wall elements must be fitted. The elimination of any complex fitting step for each wall element increases the rate at which the wall can be erected. Moreover, while a wall can be erected to precise dimensions, tolerances within the components of the subject invention are less strict than with other wall construction techniques. This factor also promotes accelerated wall erection time.

(5) The rounded groove and the co-operating rounded tongue of the basic wall element permit the wall elements according to the subject invention to be slid easily into place over the matching tongue or groove of the wall blocks in a lower course in the wall. Furthermore, the rounded shape of the tongue and the groove tends to reduce chipping damage to the basic wall element and hence reduce the number of wall elements that must be discarded in erecting any particular wall. The matching tongue and groove design of the subject wall elements also tends to increase the lateral stability of the wall, thereby reducing the necessity to rely upon the H-shaped cross-ties for lateral stability. Further stability can be obtained by applying adhesive between the tongue and groove on adjoining wall elements.

(6) The protruding tongue construction of the basic wall elements provides a ridge behind which the leg of the H-cross-tie fits, thus providing improved holding characteristics for the wall element H-cross-tie combination over a simple groove in the surface of the element in which the leg of the H-cross-tie rests.

The invention in one embodiment is directed to a wall element for use in association with other similar wall elements in the construction of a wall, the wall element having a top, a bottom, two side and two end surfaces, and at least one longitudinal groove in the top or bottom surface thereof, and a matching longitudinal ridge in the opposite top or bottom surface thereof, second and third horizontal longitudinally extending grooves on at least the top surface of the wall element both being parallel to the first longitudinal groove, the second and third grooves being located in the region of the respective ends of the top surface of the wall element.

In the wall element described above, the wall element may be of generally rectangular shape on each of its broad opposing side surfaces, and the top, bottom and two end surfaces of the wall element may be relatively thin in thickness in comparison with the width and length of the two broad side surfaces.

In the wall element described, the second and third grooves on the top surfaces of the wall element may be adapted to receive at least a portion of the legs of two separate H-shaped cross-ties. The wall element may be constructed of concrete.

In the wall element described, the first longitudinal groove and the first longitudinal ridge may be of rounded shape when viewed in cross-section, and the radius of the rounded ridge and the radius of the rounded groove may be approximately the same.

The invention in another embodiment is directed to a wall constructed by utilizing a plurality of the wall elements as described above, wherein the wall elements may be laid in series end to end in at least two superimposed courses in two parallel opposing rows, each of the two parallel courses being of generally the same height and each wall element in each course having an opposite member directly across in the opposing row, the top and bottom surfaces of each wall element overlying or underlying and abutting members in the courses of wall elements above and below, the wall elements being secured together by horizontally disposed H-shaped cross-ties, one lower extension of the H-shaped cross-tie fitting into one of the second or third horizontal grooves on the top surface of one of the wall elements in one row, the other lower extension of the H-shaped cross-tie fitting into one of the second or third horizontal grooves on the top surface of the corresponding wall element in the opposite row, the cross-bar of the H-shaped cross-tie extending between the two opposing elements, one upper extension of the H-shaped cross-tie corresponding to the first lower extension fitting into one of the second or third horizontal grooves on the top surface of one of the wall elements in the same course abutting the first wall element in end-to-end relation, the other upper extension of the H-shaped cross-tie corresponding to the other lower extension fitting into one of the second or third horizontal grooves on the top surface of one of the wall elements in the same course abutting the wall element in end-to-end relation, in the opposite row of wall elements, the cross-bar of the H-shaped cross-tie extending between the two opposing wall elements and linking the two opposing wall elements together.

In a wall constructed by utilizing a plurality of wall elements as described above, the wall elements may be laid in series in a linear direction end to end in two parallel rows on a footing, and may be linked together by horizontal H-shaped cross-ties.

In a wall constructed by utilizing a plurality of wall elements as described above, the wall elements may also be laid in series in a linear direction end to end in two parallel rows on a footing, and the bases of the plurality of wall elements extending in two parallel rows rest in two parallel longitudinal grooves that are formed in the top surface of the footing.

The invention in another embodiment is also directed to a structure comprised of a permanent form and concrete or other filler material poured into the form, wherein the form has inner and outer conforming sides and a pour space in between, the inner and outer sides being comprised of a plurality of wall elements arranged in edge-to-edge and end-to-end abutting relationship, the wall elements having horizontal grooves in the top surfaces of the wall elements adapted to receive stabilizing elements in the shape of H-shaped cross-ties, the legs of the H-shaped cross-ties being adapted to engage in the horizontal grooves, the horizontal bar of the H-shaped tie extending between and securing together the inner and outer sides relative to one another.

In the structure described, the side members may be made of precast concrete. In the structure described, the outer faces of the side members may also have architecturally precast textured finishes.

In the structure described, the top and bottom surfaces of the wall elements may have matching tongue and groove designs so that when two wall elements are superimposed in bottom surface upon top surface relationship above one another, the upper wall element meshes with the lower element.

In the structure described, the respective end surfaces of the wall elements may have a matching tongue and groove design so that a first wall element placed in end-to-end abutting relationship with another wall element meshes with the other element.

The invention in another embodiment is also directed to a wall made up of inner and outer walls composed of two series of matching opposed wall elements arranged in superimposed courses in edge-to-edge and end-to-end abutting relationship, thereby providing a pour space between the inner and outer walls for filling with poured concrete or other suitable material, each wall element having on the top and bottom surfaces thereof respective co-operating tongue and grooves which fit with adjoining, abutting wall elements, the tongue and grooves on the top and bottom surfaces of the wall elements extending over the length of the wall elements, the wall elements being planar units being of relatively broad width and length and relatively thin thickness, the wall elements being linked together by horizontally disposed H-shaped cross-ties the legs of which co-operate with horizontal receiving grooves in the top surfaces of the wall elements in order to secure the two series of wall elements in rigid vertical and rigid spaced relationship to define the pour space between the walls, the pour space between the walls being filed with concrete or other suitable material.

In the wall described, each wall element used in constructing the wall may have at least one horizontal groove in the top surface thereof adapted to receive the horizontal leg of an H-shaped cross-tie, and a tongue and a matching groove being formed on at least the respective top and bottom surfaces of the wall element, the matching tongue and groove extending substantially the entire length of the top and bottom surfaces respectively of the wall element.

In the wall described above, the wall element may be of generally rectangular shape, on each of its broad opposing faces, the wall element being relatively thin in thickness in comparison with the width and length of the opposing broad faces, and the tongue and the matching groove on the top and bottom surfaces may respectively extend over the respective end surfaces of the wall element.

Further understanding of the invention may be had by reference to the accompanying drawings which illustrate specific embodiments of the invention.

DRAWINGS

In the drawings:

FIG. 8 represents a perspective view of alternative methods of forming corner constructions with two parallel rows of wall elements linked together with H-cross ties.

FIGS. 9, 10, 11, 12, 13 and 14 illustrate cross-sections of various constructions of footings.

DETAILED DESCRIPTION

Figure 1:
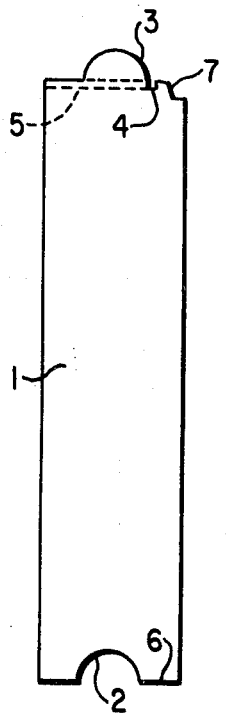
FIG. 1 represents an end view of a wall element according to one form of the invention.

Referring to FIG. 1, which represents an end view of a wall element 1, the wall element 1 is formed with a concave bottom groove 2, in the bottom face of the wall element 1, and a complementary convex top ridge or tongue 3, which is rounded so that it has the same general radius as concave bottom groove 2. Thus, top ridge 3 is formed to match and fit with the bottom groove 2 of a similarly constructed wall element 1. In the embodiment of wall element 1 shown in FIG. 1, the two end faces, one in full view and the other in hidden view, and the broad front and back faces, shown in profile, are flat.

Located on the top surface of the wall element 1 is a tie groove 4 which is located adjacent and parallel with top ridge 3. An optional lateral tie groove 5 may also be formed in the top face of wall element 1. The bottom face of wall element 1 adjoining bottom groove 2 is identified as bottom element face 6.

To avoid an unsightly monolithic broad face appearance to a wall erected with a plurality of abutting wall elements 1 in courses, a front face recess 7 is formed at the top front edge of the wall element 1. Thus, when a plurality of wall elements 1 is assembled in abutting end-to-end relationship superimposed upon each other to form courses, front face recess 7 provides a sight-relieving groove at each element intersection that extends the length of the front face of the wall erected from the plurality of wall elements 1.

Figure 2:
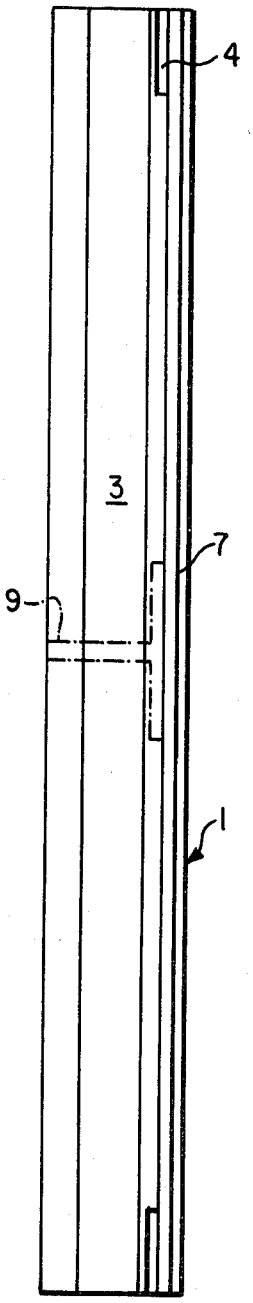
FIG. 2 represents a top view of one form of the wall element.

Turning to FIG. 2, which shows a top view of wall element 1, it can be seen that the top rounded ridge 3 extends the length of the wall element 1. Two tie grooves 4 are positioned at the two respective ends of the top face of the wall element 1. The front face recess 7 also extends the length of the wall element 1. FIG. 2 also illustrates the optional lateral top face mid-groove 9, which can be located midway the length of wall element 1 to accommodate an additional H-cross-tie for extra stability.

Figure 3:
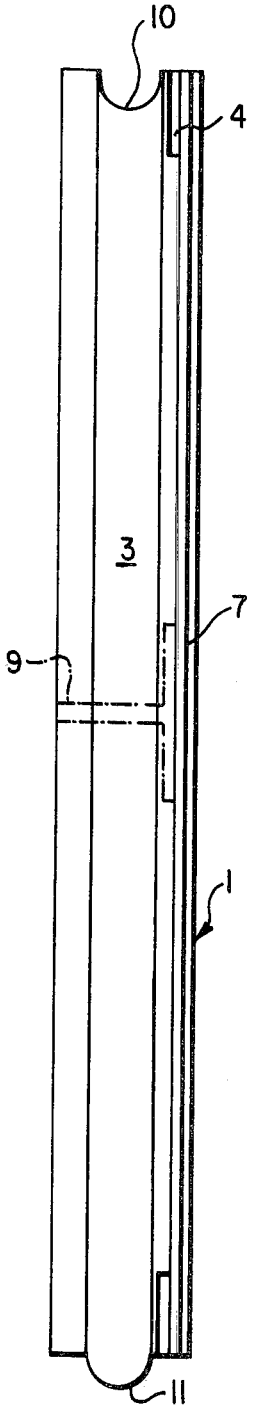
FIG. 3 represents a top view of an alternative form of the wall element wherein tongue and grooves are formed on the end faces of the wall element as well as on top and bottom faces of the wall element.

With reference to FIG. 3, which illustrates a top view of an alternative embodiment of wall element 1, it can be seen that the wall element 1, in addition to rounded top ridge 3, and front face recess 7, can be constructed to have an end face groove 10 at one end face of the wall element 1, and a rounded end face ridge 11 at the other end of the wall element 1. The radius of curvature of end face groove 10 is substantially the same as rounded end face ridge 11 so that end ridge 11 of one wall element 1 will fit snuggly into the end face groove 10 of an adjoining wall element 1, when a plurality of wall elements 1 are laid in end to end abutting orientation.

Figure 4:
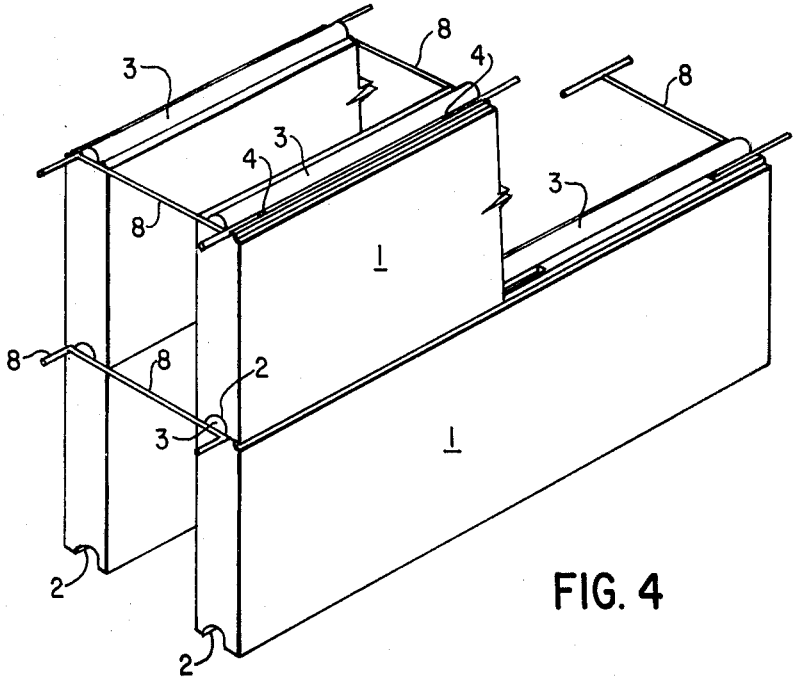
FIG. 4 represents a perspective view of the manner in which two parallel rows of wall elements are linked together by horizontal H-cross ties to form a basic wall unit.

FIG. 4 illustrates the manner in which a plurality of wall elements 1 are assembled together in superimposed relationship to form two adjacent parallel walls. In assembling a wall composed of two parallel rows of wall elements, two wall elements 1 are first set in parallel relationship, opposing one another, on a suitable foundation such as a footing, and then two corresponding wall elements 1 are laid on top of the first two parallel wall elements, the bottom grooves 2 of the upper two wall elements 1 fitting upon the respective top ridges 3 of the two underlying base wall elements 1. The opposing pairs of parallel wall elements 1 are held in place opposite one another by means of horizontally disposed H-shaped cross-ties 8, the legs of which fit in the tie grooves 4 formed at the ends of each of the top faces of the pairs of wall elements 1. By repeating the foregoing described assembly procedure, and utilizing additional wall elements 1 and H-cross ties 8, an entire wall system can be constructed, with two opposing parallel outside faces, and a pour space therebetween, which can be filled with poured concrete or some other suitable wall forming material.

Figure 5:
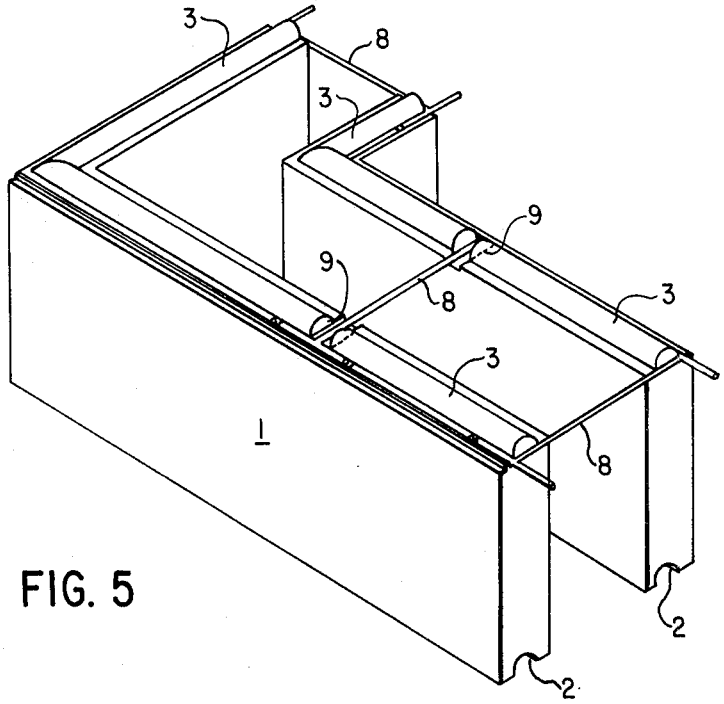
FIG. 5 represents a perspective view of a corner construction comprising two parallel rows of wall elements linked together with horizontal H-cross ties.

FIG. 5 demonstrates the manner in which a corner can be formed from the basic wall element 1, laid in pairs. The 90° corner-type wall element 1 can be specially formed from specially designed molds, or the corner construction can be formed simply by vertically breaking basic wall elements 1 into required lengths in order to construct on site wall corners as required by the job specification. The ends of the respective parallel wall elements 1 are linked together by horizontally disposed H-cross-ties 8.

FIG. 5 also demonstrates how an H-shaped cross-tie 8 can be positioned in horizontal orientation at midpoint grooves 9 on the upper faces of opposing wall elements 1. The provision of H-cross ties 8 at midpoints along the top faces of the opposing wall elements 1 provide the outer wall elements 1 with additional strength to withstand translated hydrostatic pressures that may occur when concrete is poured in the space that exists between the opposing faces of the wall elements 1.

Figure 6:
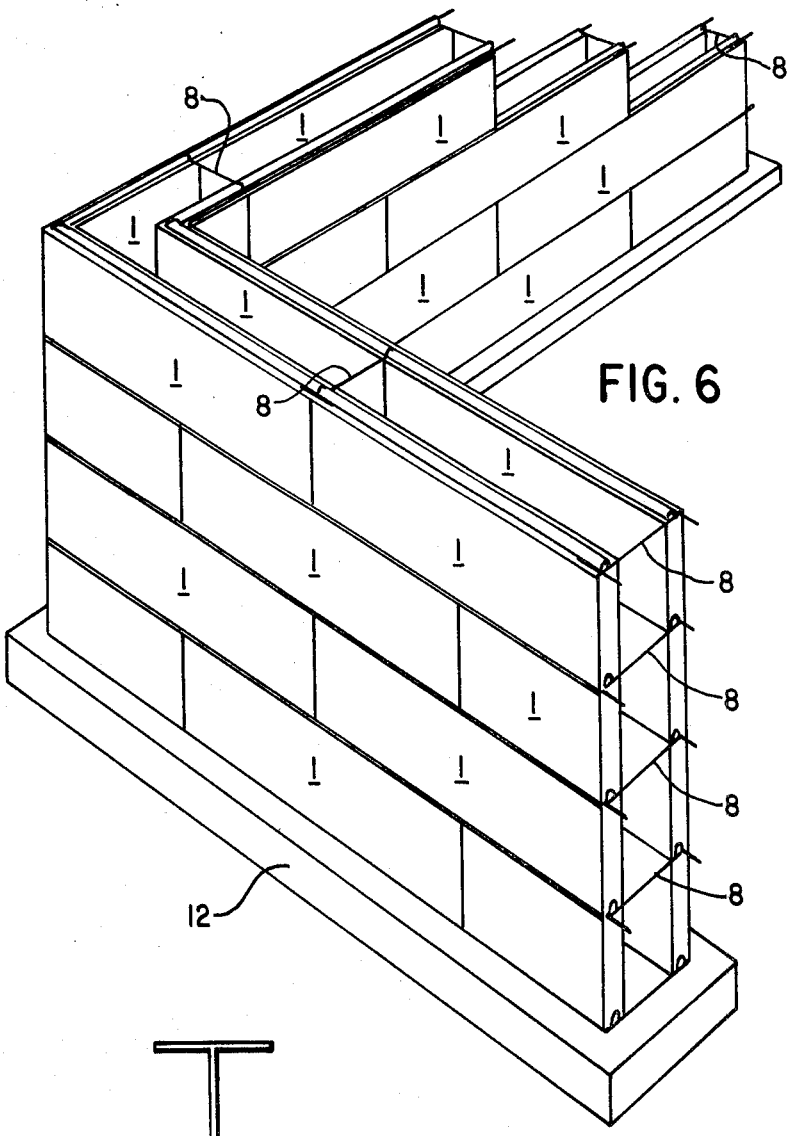
FIG. 6 represents a perspective view of a partially formed wall comprising two parallel courses of wall elements arranged in abutting end to end and superimposed relationship linked together by horizontal H-cross ties.

FIG. 6 illustrates in perspective view a partial assembly of a plurality of abutting wall elements 1 arranged in courses to form two parallel walls which run through a 90° corner, the two parallel walls being linked together by a plurality of H-cross ties 8 being set in the respective tie grooves 4 located on the top surfaces of each wall element 1. The wall assembly rests upon a footing 12, which is common construction practice.

Figure 7:
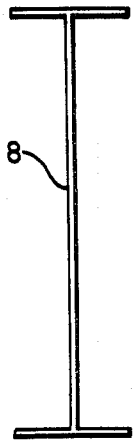
FIG. 7 represents a front view of an H-cross tie.

A detail of the H-cross tie is shown in FIG. 7. This H-cross tie 8 is always laid horizontally so that the legs of the H-cross-tie are received in the horizontal tie grooves 4 formed in the top surfaces of the wall elements 1. The advantage of having the H-cross tie 8 lie in horizontal position is that no vertical projections exist over which overlying wall elements 1 must be fitted in place, as in the Rudichuk construction disclosed and claimed in Canadian Pat. Nos. 922,495 and 941,588. The absence of vertical projections increases wall erection time and minimizes the chance that such vertical projections will be bent or damaged.

FIG. 8 illustrates alternative corner constructions that can be used in place of the corner constructions illustrated in FIGS. 5 and 6 above. In FIGS. 5 and 6, no horizontally disposed H-cross ties were present at the precise corners. However, as demonstrated in FIG. 8, H-cross ties 8 can be located directly at the corner of the inside wall element so that in effect one H-cross tie **8*a* continues in a line with one of the interior wall elements 1*a* while the other H-cross tie 8*b* continues in a line with wall element 1*b***.

In a further alternative, H-cross ties **8*a* and 8*b* need not be present and a single diagonally oriented H-cross tie 8*c* can be used. In this system, the legs of H-cross tie 8*c* must be bent (which can be done on the job site) so that the overall cross-tie 8*c* takes on an "arrow" shape. This is necessary so that the legs of the H-cross tie 8*c* will fit in the angled tie grooves 4 of the respective corner wall elements 1**.

In the construction of a basic wall made up of a plurality of wall elements 1, it is customary to first pour a concrete footing (See footing 12 in FIG. 6) to serve as a base for the wall. The top surface of the footing may be constructed to accommodate the overlying rows of parallel walls according to well-known construction techniques, for example, forming a pair of parallel grooves in the top surface of the footing so that the bases of the parallel rows of wall elements are received in the grooves. These grooves thereby provide a holding action against lateral pressure exerted on the bases of the plurality of wall elements caused by poured concrete or other filling material.

The two parallel walls are erected by laying a first course of wall elements 1 in end-to-end abutting relationship, and a second course of opposed parallel wall elements 1 directly opposed to the wall elements in the first wall, the two courses of parallel wall elements 1 thereby defining a pour space in between. The two parallel rows of wall elements are secured in place by laying H-cross ties 8 horizontally in each of the tie grooves 4 that are formed on the top surface at the ends of each of the wall elements 1. The cross-bar of the H-cross tie extends from the top of one wall element 1 in perpendicular manner directly across the pour space to the opposite wall element 1. It will be recognized that the inner and outer walls comprised of a plurality of wall elements 1 must be spaced apart a distance that corresponds basically with the length of the cross bar of the H-cross tie 8 so that the legs of each H-cross tie 8 are received in the respective horizontal tie grooves 4 of the wall elements 1. Furthermore, the opposing wall elements 1 in the parallel rows must be placed so that they are directly opposed to one another so that the tie grooves 4 are directly across from each other. This orientation enables the horizontal legs of the H-cross ties 8 to be laid in position in the grooves 4 located at the ends of the top surface of the opposing wall elements 1.

Once the first course of wall elements 1 is in place in the two parallel rows, the second course of inner and outer wall elements 1 is then placed in end-to-end abutting relationship on top of the first course of the two opposing parallel rows wall elements 1. It is customary, as in conventional brick-mortar wall construction, to stagger the position of the wall elements 1 of the second course of wall elements 1 so that the end joints of the second course of wall elements 1 meet at about the midpoint of the wall elements 1 forming the underlying first course of wall elements 1. The bottom grooves 2 of the overlying second course of wall elements 1 fit precisely over the top ridges 3 of the first course of wall elements 1, to provide a snug fit which is capable of withstanding lateral pressure being placed upon the courses of wall elements 1. The tongue and groove arrangement complements the strength provided by the cross-linking H-cross ties 8.

In the manner described, successive courses of wall elements 1, linked together by the tongue and groove construction and the required number of H-cross ties 8, are laid until a wall of desired height is reached. Once the desired height of wall is reached, the pour space formed between the opposing parallel walls can be filled with poured concrete or some other suitable filling material.

In an alternative embodiment of the invention, wall elements 1 which have grooves 10 and ridges 11 on the end faces of the wall elements 1, in addition to the ridges and grooves on the top and bottom surfaces, can be utilized. Such wall elements 1 can be used where it is desired to have the plurality of wall elements 1 mesh by tongue and groove technique not only on the respective top and bottom surfaces of the wall elements 1, but also at the respective ends of the wall elements 1. Wall elements 1 having the end grooves 10 and end ridges 11 are more expensive to construct, but the use of such wall elements 1 may be advisable where a particularly strong wall is required, or it is desired to provide a barrier between the abutting wall elements 1 to minimize the passage of moisture and other matter into the interior space of the opposing parallel rows of wall elements 1.

The wall elements 1 may be formed from pre-cast concrete, and may optionally incorporate embedded wire, or other reinforcing rods, to provide additional strength to the wall elements 1. This may be necessary to provide resistance to fracturing, particularly in applications where a relatively high lateral strength is required, such as in situations where walls of extreme height are being formed, or where the wall elements 1 are relatively thin in width.

FIGS. 9, 10, 11, 12, 13 and 14 illustrate cross-sectional views of various alternative methods whereby the wall element 1, may be positioned in pairs, on footings. These methods are merely exemplary and are not to be considered as exhaustive.

FIG. 9 illustrates the positioning of pairs of wall elements 1 in pairs of grooves 19 in the footing 12.

FIG. 10 illustrates a method whereby the wall elements are held in place by boards 13 which are temporarily nailed to the footing 12 by nails 14, which are removed after the wall has been built.

FIG. 11 illustrates a method whereby a single broad groove 15 is formed in the footing 12.

FIG. 12 illustrates a system of holding the wall elements in place by means of a U-shaped bracket 16 embedded in the footing 12.

FIG. 13 illustrates a construction where the pairs of wall elements 1 are held in place by pins 17 embedded in pairs in the footing 12.

FIG. 14 illustrates a method of holding the wall elements 1 in place by means of a U-shaped bracket 18 positioned on the footing 12.

While particular embodiments of this invention have been described and shown, it will be understood that many modifications may be made to the invention to adapt it to other models and designs without departing from the spirit of the invention, and it is contemplated by the appended claims to cover any such modifications as fall within the true spirit and scope of this invention.

The embodiments of the invention in which an exclusive property or privilege is claimed are defined as follows:

1. A system for constructing a wall, said wall comprising a pair of spaced parallel relatively thin walls defining a hollow space therebetween adapted to be filled with poured-in-place concrete;

said system comprising in combination:

(a) a plurality of H-shaped ties formed from rod-like material, each said tie comprising a pair of parallel spaced side members joined by a cross-member extending between points intermediate the ends of the respective side members whereby each side member comprises two rod-shaped legs one extending from each side of said cross-member; and (b) a plurality of wall elements, each said wall element having a top, a bottom, an interior and an exterior generally rectangular side surface and two end surfaces, and at least one longitudinal groove in the top or bottom thereof, and a matching longitudinal ridge in the opposite bottom or top thereof, second and third horizontal longitudinally extending grooves on at least the top of the wall element, both being parallel to the first longitudinal groove, the second and third grooves being located in the region of the respective ends of the top of the wall element, each of said second and third grooves lying in the same longitudinal line at the exterior side of the longitudinal ridge or groove in the top of the wall element, and being so configured as to accommodate one leg of one of said H-shaped ties.

2. A system according to claim 1, wherein the first longitudinal groove and the longitudinal ridge on each wall element are of substantially semicircular cross-section, the radius of the rounded ridge and the radius of the rounded groove being approximately the same.

3. A wall structure constructed by utilizing the system of claim 1, said wall structure comprising:

a pair of relatively thin spaced parallel walls defining a hollow space therebetween, each said wall being formed from a plurality of superimposed courses of said wall elements, the longitudinal ridges of the wall elements being received in the first longitudinal grooves of vertically adjacent wall elements, the interior side surfaces of the wall elements in each parallel wall facing the interior side surfaces of the wall elements in the other parallel wall, each such wall element in one parallel wall being in alignment with a corresponding wall element in the other parallel wall; and a plurality of said H-shaped ties extending horizontally across the space between said parallel walls, the two legs of each side member of each H-shaped tie being accommodated in the second and third grooves of horizontally adjacent wall elements in one of the parallel walls.

4. A wall structure in accordance with claim 3, wherein the space defined between the parallel walls contains a suitable filler material.

5. A wall structure in accordance with claim 3, wherein the space defined between the parallel walls is filled with poured-in-place concrete.

6. A wall structure in accordance with claim 3, wherein adjacent wall elements in the parallel walls are joined together by a suitable adhesive material interposed therebetween.

7. A wall structure in accordance with claim 3, 5 or 6 wherein the first longitudinal grooves and the longitudinal ridges of the wall elements are of substantially semicircular cross-section, the radius of the rounded ridge and the radius of the rounded grooves being approximately the same.

8. A wall structure in accordance with claim 3, 5 or 6 wherein the respective end surfaces of the wall elements have mating tongue and groove design so that a first wall element placed in end-to-end abutting relationship with another wall element meshes with the other element.

9. A wall structure in accordance with claim 3, 5 or 6, wherein the wall elements are laid in series in a linear direction end to end in two parallel rows on a footing, and the bases of the plurality of wall elements extending in two parallel tows rest in two parallel longitudinal grooves that are formed in the top surface of the footing.

* * * * *